US008403160B2

(12) United States Patent
Hentzel

(10) Patent No.: US 8,403,160 B2
(45) Date of Patent: Mar. 26, 2013

(54) CONTAINER WITH AUDIBLE FRESHNESS LOCKING SYSTEM

(75) Inventor: Stephane Hentzel, Yvonand (CH)

(73) Assignee: Nestec S.A., Vevey (CH)

( * ) Notice: Subject to any disclaimer, the term of this patent is extended or adjusted under 35 U.S.C. 154(b) by 204 days.

(21) Appl. No.: 12/671,395

(22) PCT Filed: Jul. 7, 2008

(86) PCT No.: PCT/EP2008/058789

§ 371 (c)(1),
(2), (4) Date: Jun. 4, 2010

(87) PCT Pub. No.: WO2009/019097

PCT Pub. Date: Feb. 12, 2009

(65) Prior Publication Data

US 2011/0036841 A1 Feb. 17, 2011

(30) Foreign Application Priority Data

Aug. 3, 2007 (EP) ..... 07113772

(51) Int. Cl.
*B65D 41/04* (2006.01)
*B65D 41/34* (2006.01)

(52) U.S. Cl. ..... 215/331; 215/330; 215/201; 215/321; 215/349; 215/341; 220/293; 220/790; 220/784; 220/782; 220/780

(58) Field of Classification Search ..... 215/331, 215/330, 321, 44, 349, 341, 201; 220/293, 220/790, 780, 784, 782
See application file for complete search history.

(56) References Cited

U.S. PATENT DOCUMENTS 2,423,582 A * 7/1947 Coleman ..... 215/252
4,335,823 A * 6/1982 Montgomery et al. ..... 215/206
4,867,354 A 9/1989 Schreiber
(Continued)

FOREIGN PATENT DOCUMENTS

EP 0520118 12/1992
EP 1561700 8/2005
GB 2 261 656 5/1993

OTHER PUBLICATIONS

International Search Report, PCT/EP2008/058789 mailed Oct. 7, 2008, 6 pages.

(Continued)

*Primary Examiner* — J. Gregory Pickett
*Assistant Examiner* — Blaine Neway
(74) *Attorney, Agent, or Firm* — K&L Gates LLP

(57) ABSTRACT

The present invention concerns a container comprising a container body with bottom and side walls and a container opening, and a container closure (1), said body and closure comprising corresponding screw threads (3) to allow releasable attachment of the closure onto the body in order to open/close the container opening, characterized in that the container body comprises at least one cam-like means (4) located on the external surface of the container body walls, and the closure comprises at least one engagement means (5) corresponding to the cam-like means of the container body, said engagement means being located at the internal surface of the closure walls, so positioned that during the screwing operation of said closure onto said container body, said cam-like and engagement means cooperate in a audible manner at the time said closure is sufficiently engaged onto the body to ensure gas and/or liquid tightness of the closed container.

10 Claims, 3 Drawing Sheets

U.S. PATENT DOCUMENTS

| | | | | | |
|---|---|---|---|---|---|
| 4,913,299 | A | * | 4/1990 | Petro | 215/330 |
| 5,186,344 | A | * | 2/1993 | Cook | 215/330 |
| 5,271,512 | A | * | 12/1993 | Ekkert | 215/252 |
| 5,803,287 | A | | 9/1998 | Kusz | |
| 6,152,315 | A | * | 11/2000 | Montgomery | 215/216 |
| 2006/0186075 | A1 | | 8/2006 | Rainey et al. | |
| 2008/0110850 | A1 | * | 5/2008 | Tilton | 215/330 |

OTHER PUBLICATIONS

Written Opinion of the International Searching Authority PCT/EP2008/058789 mailed Oct. 7, 2010, 5 pages.

* cited by examiner

CONTAINER WITH AUDIBLE FRESHNESS LOCKING SYSTEM

The present invention concerns a container, particularly but not exclusively a container for edible products, which comprises a system to guarantee that it is correctly closed for storage and transportation.

When edible products are packed in containers for storage and dispensing it is essential to guarantee that the container is correctly re-closed after the first opening so that the product freshness over time is also guaranteed.

Various packaging closing systems were developed, in order to warn the consumer when the container is correctly—i.e. fully—closed. Such systems include sensitive systems whereby the closure produces a resistance point when the said closure is sufficiently screwed onto the container neck. This resistance point during the screwing operation gives a warning to the consumer that the closure is in the "locked" position.

Such closing systems comprise corresponding protrusions or embossing of the closure and container neck that contact each other when the closure is sufficiently screwed onto the neck, so that the contact between the two makes it temporarily more difficult to screw or unscrew the closure.

However, such systems are not found sufficiently efficient to the consumers who are asking for more obvious signals on packaging containers, to give them reassurance that the product freshness will be guaranteed. More than that, some consumers stop screwing the closure even before the latter is correctly screwed because they—wrongly—believe that the resistance point they feel is an indication that the closure is completely screwed. Such a misbelieve is really a threat to the product freshness because in such a case, the container is, of course, not correctly closed.

In order to correct the above described disadvantages of the known containers, the present invention provides a container neck defining an opening, and a container closure, said neck and closure comprising corresponding screw threads to allow releasable attachment of the closure onto the neck in order to open/close the container opening, characterized in that:

(i) the container body comprises at least one cam-like means located on the external surface of the container body walls, and (ii) the closure comprises at least one engagement means corresponding to the cam-like means of the container body, said engagement means being located at the internal surface of the closure walls, so positioned that during the screwing operation of said closure onto said container neck, said cam-like and engagement means cooperate in a audible manner at the time said closure is sufficiently engaged onto the neck to ensure gas and/or liquid tightness of the closed container.

Preferably, the cam-like means is located less than 10 mm from the top edge of the container body.

Alternatively, the cam-like means is located adjacent, or even can be directly part of, the screw threads of the container neck.

In a highly preferred embodiment of the present invention, said at least one engagement means of the closure is at least one flexible tongue.

In that case, the said at least one flexible tongue is advantageously located adjacent the edge between the internal top wall and the internal side wall of the closure.

Furthermore, the said flexible tongue can comprise an indented portion to increase the tongue's flexibility.

Finally, the cam-like means preferably comprises a soft slope portion and a steep slope portion to facilitate the relative movement of said cam-like means and engagement means of the closure. However, both slopes of the cam-like element can be steep to adapt to the limits of the manufacturing process, especially if the container neck is to be made of glass.

Additional features and advantages of the present invention are described in, and will be apparent from, the description of the presently preferred embodiments which are set out below with reference to the drawings in which.

Figure 1:
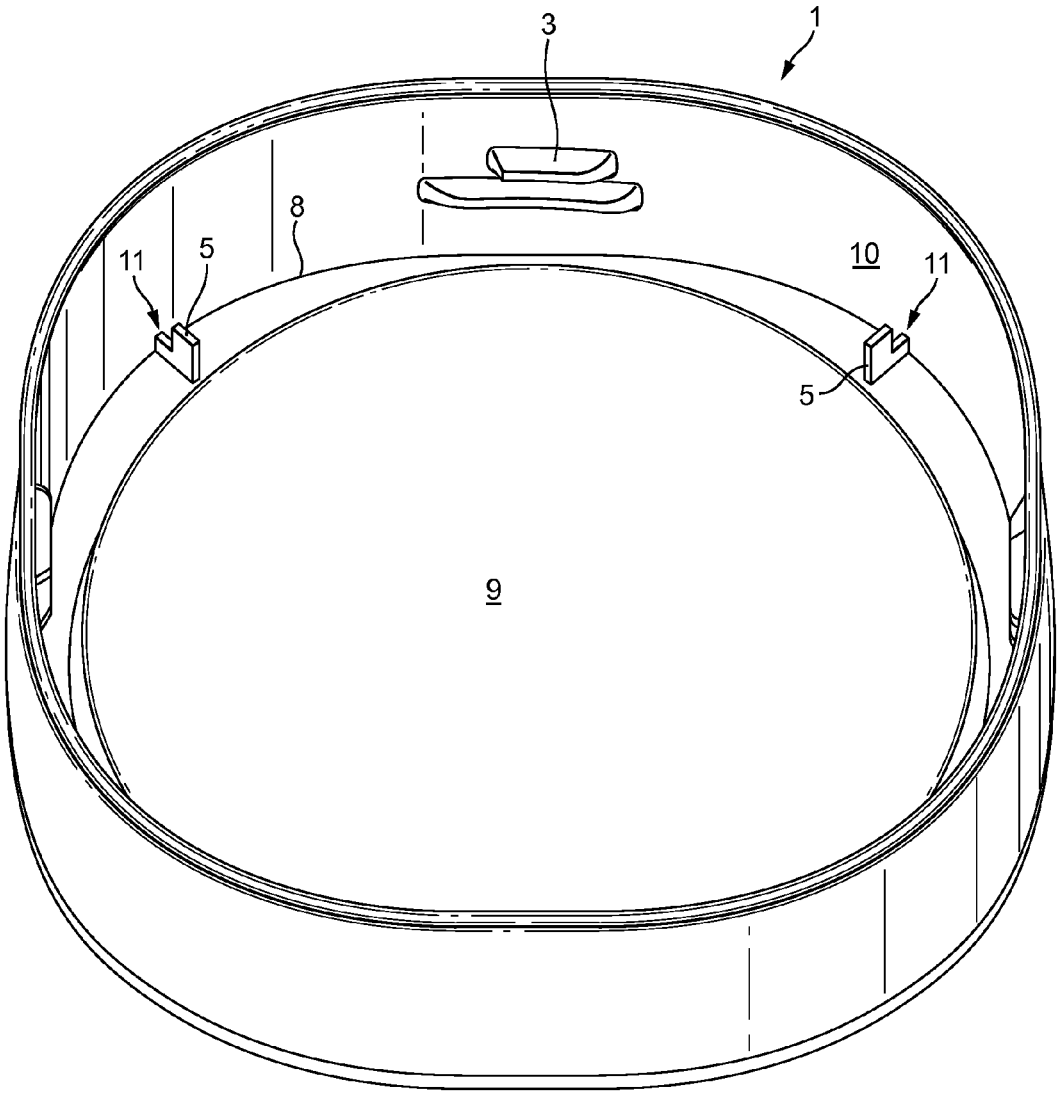
FIG. 1 is a perspective view of the closure positioned upside-down.

The present invention, as shown in the drawing, concerns a container (not fully represented in the drawing) comprising a container body and a container closure 1. As can be seen in the figures, the drawing represents essentially partial views of the container.

The container body comprises bottom and side walls and a container neck 2 defining an opening. The container neck 2 and the closure 1 also comprise corresponding screw threads 3 to allow releasable attachment of the closure 1 onto the body in order to open/close the container opening.

According to the present invention, the container body comprises at least one cam-like means 4 located on the external surface of the container body walls, and the closure 1 comprises at least one engagement means 5 corresponding to the cam-like means 4 of the container body.

Figure 3:
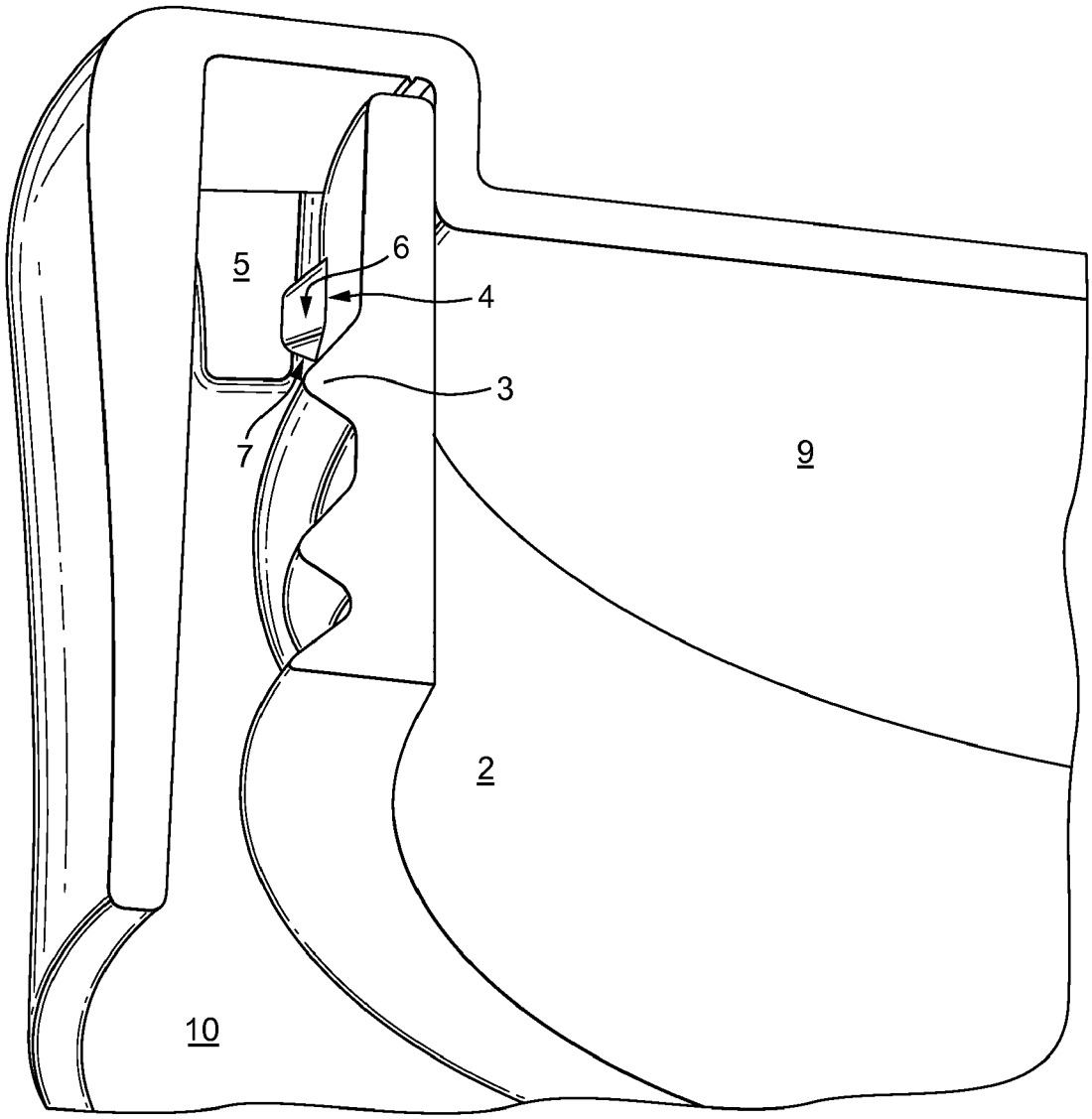
FIG. 3 is an enlarged partial perspective view with the closure screwed onto the container neck.

As shown in FIG. 3, the engagement means 5 is located at the internal surface of the closure walls, so positioned that during the screwing operation of the closure 1 onto the container neck 2, the said cam-like 4 and engagement 5 means cooperate in a audible manner at a time said closure is sufficiently engaged onto the neck to ensure gas and/or liquid tightness of the closed container.

As can be seen in FIG. 3, the cam-like means 4 is located adjacent the top edge of the container body. It comprises a soft slope portion 6 and a steep slope portion 7 to facilitate the relative movement of said cam-like means 4 and engagement means 5 of the closure 1.

Figure 2:
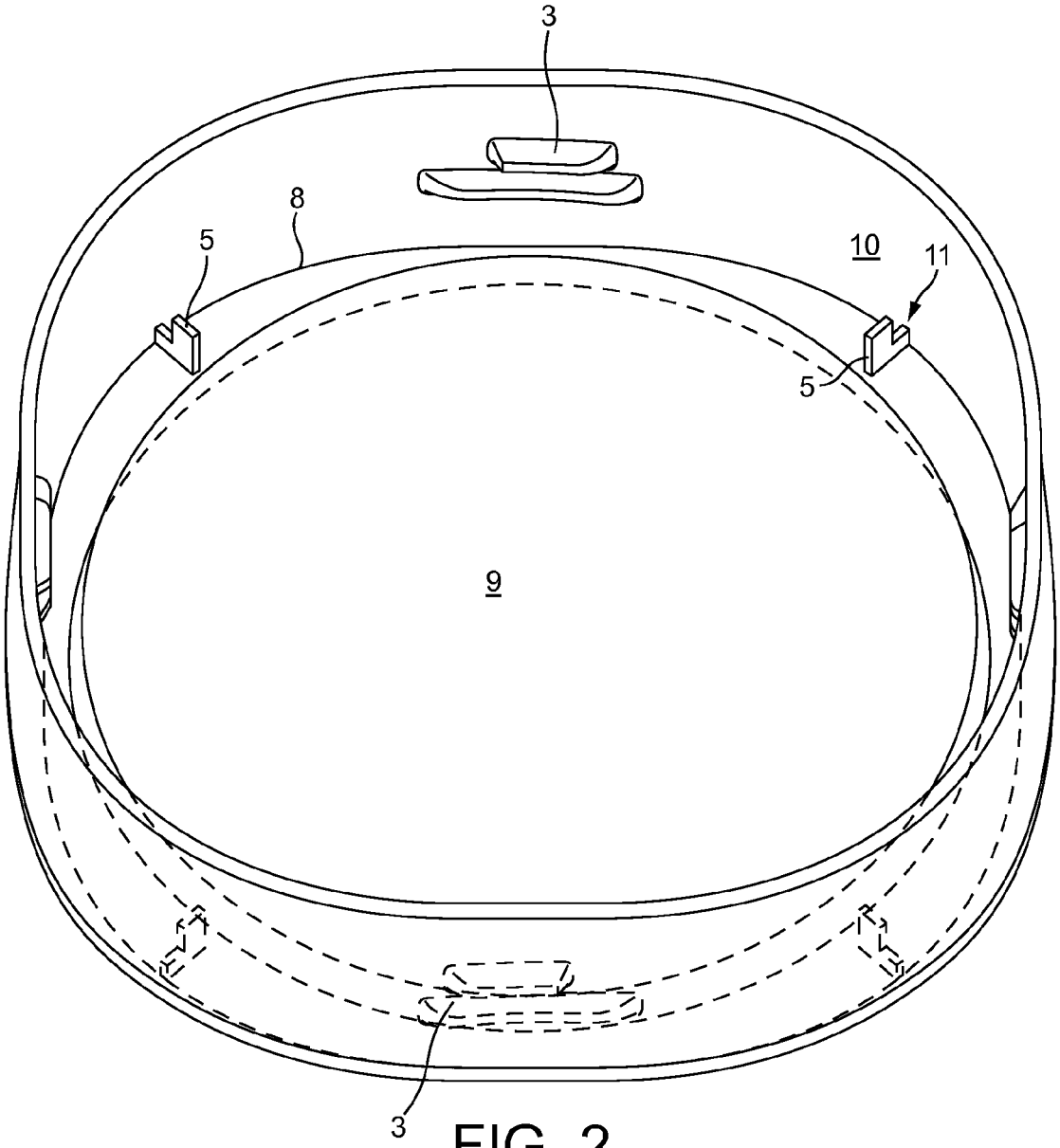
FIG. 2 is a similar view to FIG. 1, the closure being shown in transparency.

Furthermore, as can be seen from FIGS. 1, 2 and 3, the engagement means of the closure 1 is made of four flexible tongues 5.

The four flexible tongues 5 are located adjacent the edge 8 between the internal top wall 9 and the internal side wall 10 of the closure 1, spaced apart at an angle of 45° from one another.

Furthermore, each said flexible tongue 5 comprises an indented portion 11 to increase the tongue's flexibility, as shown for instance in FIG. 1.

The efficiency of the present invention, and the good quality of the sound obtained is particularly due to the flexibility of each flexible tongue 5, that deflects when it passes onto the soft slope 6 of the cam-like means 4 during screwing of the closure 1 onto the neck 2. At this stage, due to the soft slope, the mechanical resistance to screw the closure onto the neck is low and therefore the risk is low that the consumer could be confused by the resistance to screwing, and wrongly think that the closure is completely screwed.

In engineering mechanics, deflection is a term that is used to describe the degree to which a structural element—here, each flexible tongue—is displaced under a load—here the load is applied directly by the consumer by the screwing force, via the cam-like means of the container neck—.

The deflection of each flexible tongue under the load applied by the consumer is directly related to the slope of the deflected shape of the tongue under that load and can be calculated by integrating the function that mathematically describes the slope of the tongue under that load that is applied.

The elastic deflection f and angle of deflection $\phi$ (in radians) compared to the position of the flexible tongue at rest can be calculated (at the free end of the flexible tongue) using:

$$f=F\times L^3/(3\times E\times I)$$

$$\phi=F\times L^2/(2\times E\times I)$$

where:

F=force acting on the tip of the beam

L=length of the beam (span)

E=modulus of elasticity

I=area moment of inertia

The deflection at any point along the span can be calculated using the above-mentioned methods.

From this formula it follows that the span L is the most determinating factor; if the span doubles, the deflection increases 8 folds.

When the free end of one flexible tongue 5 escapes the cam-like means 4, it is suddenly released due to the steep second slope portion of the cam-like means, and starts vibrating. The vibrations of the blade constituted by each flexible tongue of the closure, produces a vibration in the ambient air, which generates a sound. In the field of the present invention, due the length of each flexible tongue which is quite short, and also due to the nature of the thermoplastic that is used, the vibration frequency of each tongue is quite high, which produces a short sound like a "click". This is enough to be audible and warn the consumer that the closure is correctly and fully screwed to protect the freshness of the container contents.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The invention claimed is:

1. A container comprising a container body with bottom and side walls and a container neck defining an opening, and a container closure with a top wall and a side wall, the neck and closure comprising corresponding screw threads to allow releasable attachment of the closure onto the neck in order to open/close the container opening:

the container body comprises at least one cam-like means located on the external surface of the container body walls, and the closure comprises at least one engagement means corresponding to the cam-like means of the container body, the engagement means comprising an indent and a flexible tongue, the flexible tongue extending downward relative to the top wall, the engagement means having an L shape formed by the indent and the flexible tongue, the indent being located between the flexible tongue and the side wall of the closure, the engagement means being located at the internal surface of the closure walls, and so positioned and arranged that during the screwing operation of the closure onto the container neck, the cam-like means and the engagement means cooperate in an audible manner at the same time the closure is sufficiently engaged onto the neck to ensure at least a liquid tightness of the closed container.

2. A container according to claim 1, wherein the cam-like means is located less than 10 mm from a top edge of the container body.

3. A container according to claim 1, wherein the cam-like means is located adjacent the screw threads of the container neck.

4. A container according to claim 1, wherein the at least one engagement means is located adjacent the edge between the internal top wall and the internal side wall of the closure.

5. A container according to claim 1, wherein the indent increases the tongue's flexibility.

6. A container according to claim 1, wherein the cam-like means comprises a soft slope portion and a steep slope portion.

7. A container according to claim 1, wherein the engagement means extends from the top wall of the closure.

8. A container according to claim 7, wherein the engagement means also extends from the side wall of the closure.

9. A container according to claim 1, wherein the top wall of the closure has a recession adjacent the side wall of the closure, the engagement means being located at least partially within the recession.

10. A container according to claim 1, wherein the engagement means extends from the edge between the internal top wall and the internal side wall of the closure.

* * * * *